US008538057B2

(12) United States Patent
Ikeda et al.

(10) Patent No.: US 8,538,057 B2
(45) Date of Patent: Sep. 17, 2013

(54) HIGHLY DIRECTIONAL MICROPHONE

(75) Inventors: Tatsuya Ikeda, Tokyo (JP); Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 77 days.

(21) Appl. No.: 13/155,803

(22) Filed: Jun. 8, 2011

(65) Prior Publication Data

US 2011/0305359 A1 Dec. 15, 2011

(30) Foreign Application Priority Data

Jun. 11, 2010 (JP) ..... 2010-134078

(51) Int. Cl.
*H04R 1/32* (2006.01)

(52) U.S. Cl.
USPC ..... 381/356; 381/150; 381/355

(58) Field of Classification Search
USPC ..... 381/356, 150, 355
See application file for complete search history.

(56) References Cited

U.S. PATENT DOCUMENTS

| | | | | |
|---|---|---|---|---|
| 5,611,508 | A * | 3/1997 | Palmero | 248/123.2 |
| 6,560,346 | B2 * | 5/2003 | Ohta et al. | 381/382 |
| 2007/0025576 | A1 * | 2/2007 | Wen | 381/361 |
| 2010/0260369 | A1 * | 10/2010 | Suzuki | 381/360 |

FOREIGN PATENT DOCUMENTS

JP 2000-083292 3/2000

* cited by examiner

*Primary Examiner* — Brian Ensey
*Assistant Examiner* — Sabrina Diaz
(74) *Attorney, Agent, or Firm* — Whitham Curtis Christofferson & Cook, PC

(57) ABSTRACT

A highly directional microphone includes an acoustic tube and a microphone unit that is disposed inside the base end of the acoustic tube. The acoustic tube is composed of an elastic material. An adjustable member elongates and contracts the distance between the microphone unit and the front end of the acoustic tube. The acoustic tube is held by an acoustic-tube protector having openings on a peripheral wall thereof. The base end of the acoustic tube is integrated to the acoustic-tube protector, and the front end of the acoustic tube is connected to a sliding cylinder that is slidably fitted in the axis direction of the acoustic tube along the acoustic-tube protector.

9 Claims, 13 Drawing Sheets

RELATED ART

HIGHLY DIRECTIONAL MICROPHONE

BACKGROUND OF THE INVENTION

1. Field of the Invention

The present invention relates to a highly directional microphone that includes an acoustic tube, and specifically, a highly directional microphone of which the directivity can be fine-tuned by a user.

2. Related Background Art

In a highly directional microphone that includes an acoustic tube, a microphone unit is disposed inside one end in a longitudinal direction or middle of the acoustic tube. Sound waves from directions other than a target direction, that is, a front end of the acoustic tube, interfere with and are cancelled by sound waves from openings on the side wall of the acoustic tube due to a time lag therebetween. The highly directional microphone, thus, has high sensitivity to the sound waves from the front end of the acoustic tube to obtain narrow directivity. Directivity of the highly directional microphone, therefore, depends on the wavelength of sound and the length of the acoustic tube. A long acoustic tube exhibits narrow directivity over a wide frequency range up to low frequency, while a short acoustic tube exhibits narrow directivity only in a high frequency region.

In general, a highly directional microphone including an acoustic tube and a unidirectional condenser microphone unit which are combined with each other, is designed to operate in a unidirectional mode at a frequency band equal to or lower than a band in which the acoustic tube exhibits narrow directivity.

An example of the highly directional microphone including acoustic tube and a unidirectional condenser microphone unit which are combined with each other is disclosed in Japanese Unexamined Patent Application Publication 2000-083292.

In general, a polar pattern at a low frequency band of the highly directional microphone including a combination of the condenser microphone unit and acoustic tube is designed to be hypercardioid for reducing the sound waves from the side direction. If a noise source is present at 180-degree direction, that is, at the rear end of the acoustic tube, the sound waves of an extremely low frequency band are disadvantageously picked up. Within the frequency band in which the highly directional microphone unidirectionally operates, it is preferable to adjust the angle in order to avoid a reduction in the sensitivity in response to the direction of the noise source, that is, it is preferable to adjust the directivity.

A possible measure to adjust the directivity of the highly directional microphone is adjustment of the acoustic resistance of the microphone unit. FIG. 13 illustrates an exemplary conventional highly directional microphone of which the directivity can be adjusted by adjusting the acoustic resistance of the microphone unit incorporated in the acoustic tube. FIG. 13 illustrates an elongated cylindrical acoustic tube 110 one end of which is connected to a tubular microphone unit holder 120. A microphone unit 130 is disposed inside the tubular microphone unit holder 120. Hereinafter, the end of the acoustic tube 110 at which the microphone unit 130 is disposed is referred to as a rear end and the opposite end thereof as a front end. In this example, the microphone unit 130 is a condenser microphone unit and, as is well known, includes a diaphragm composed of a thin film and a fixed electrode that faces the diaphragm with a slight gap therebetween. The microphone unit 130 itself has unidirectional directivity and includes the diaphragm that is disposed so as to face the front end of an acoustic tube 110. The diaphragm and the fixed electrode constitute the condenser. Vibration of the diaphragm receiving the sound waves varies the capacitance of the condenser, and the variable capacitance is output as a change in electric signal. A front cap 160 is attached to the front end of the acoustic tube 110.

Slits (not shown) are formed on the peripheral surface of and parallel to the central axis of the acoustic tube 110. The sound waves from directions other than the target direction, that is, other than the front-end direction of the acoustic tube 110 enter the acoustic tube 110 through the slits and the front end of the acoustic tube 110. The sound waves that enter the acoustic tube 110 through the slits and the sound waves that enter the acoustic tube 110 through the front end thereof interfere with and cancelled by each other inside the acoustic tube 110 because they enter the acoustic tube 110 at a certain time lag. Accordingly, the sound pressure that reaches the microphone unit 130 decreases. In contrast, the sound pressure of the sound waves from the front end direction of the acoustic tube 110 does not decrease. Thus, the sound waves from the front end direction are dominantly electro-acoustically converted. This achieves narrow directivity.

As explained above, in the highly directional microphone including a combination of the acoustic tube and the highly directional microphone, the acoustic resistance is adjusted for adjustment of the directivity. The conventional narrow directivity microphone in FIG. 13 includes an acoustic resistive material 133 that is disposed behind the diaphragm of the microphone unit 130 and determines the acoustic resistance of the rear acoustic terminal, and an adjustable nut 135 which adjusts the acoustic resistance by adjusting the urging force of the acoustic resistive material 133. The acoustic resistance of the acoustic resistive material 133 varies with the extent of tightening of the adjustable nut 135 to adjust the directivity.

As is shown by the conventional highly directional microphone in FIG. 13, the directivity of the highly directional microphone including a combination of the acoustic tube and a highly directional microphone can be adjusted. The adjustment of the directivity of the conventional highly directional microphone, however, requires skillful adjustment of the adjustable nut 135 of the microphone unit 130 disposed in the acoustic tube 110 or the tubular microphone unit holder 120. Since the microphone unit 130 must be directly adjusted, improper adjustment creates various problems, such as damage of the diaphragm and an increase in noise due to decreased insulation. As matters now stand, therefore, it is difficult to adjust the directivity by a user without asking a manufacture to adjust the directivity.

SUMMARY OF THE INVENTION

An object of the present invention is to resolve the problems of the above-explained conventional highly directional microphone and to provide a highly directional microphone having a simple structure that enables a user to adjust the directivity by a simple operation.

According to an aspect of the present invention, a highly directional microphone includes an acoustic tube and a microphone unit disposed inside the base end of the acoustic tube. The acoustic tube is composed of an elastic material. An adjustable member elongates and contracts the distance between the microphone unit and the front end of the acoustic tube.

The acoustic tube is composed of an elastic material and can adjust the distance between the microphone unit and the front end of the acoustic tube. Thereby, the directivity can be adjusted by elongating and contracting the acoustic tube.

DESCRIPTION OF THE PREFERRED EMBODIMENTS

A highly directional microphone according to the embodiment of the present invention will be described below with reference to the accompanying drawings.

Figure 1A:
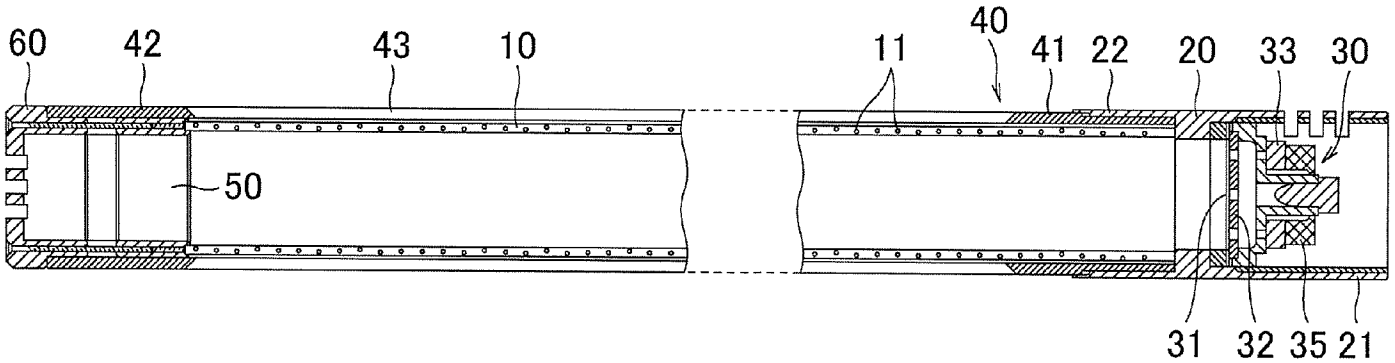
FIG. 1A is a partially-abbreviated vertical cross-sectional view of a highly directional microphone according to an embodiment of the present invention.
Figure 1B:
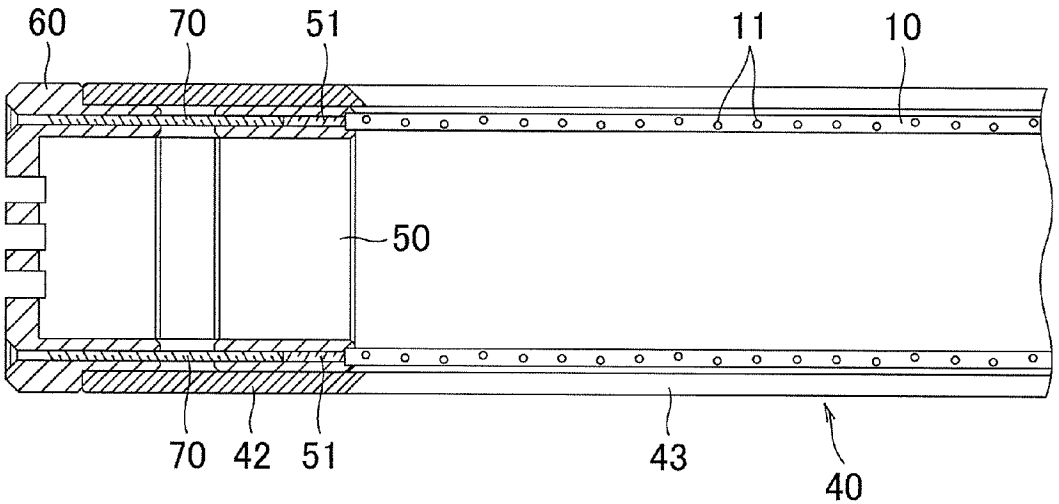
FIG. 1B is a partially-enlarged vertical cross-sectional view of the embodiment.
Figure 2A:
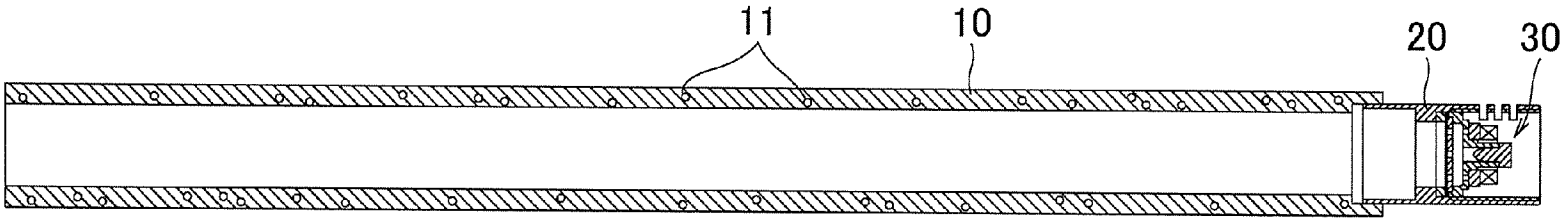
FIG. 2A is a main part of the vertical cross-sectional view illustrating the original state where pull strength is not applied to an acoustic tube of the embodiment.
Figure 2B:
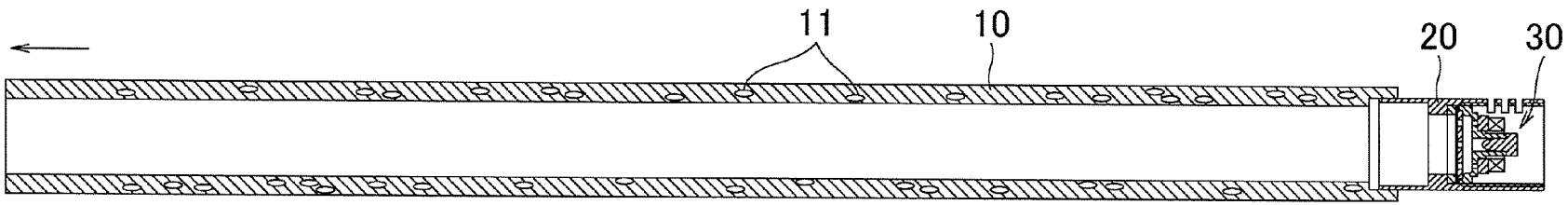
FIG. 2B is a main part of the vertical cross-sectional view illustrating a state where pull strength is applied to the acoustic tube of the embodiment.
Figure 3:
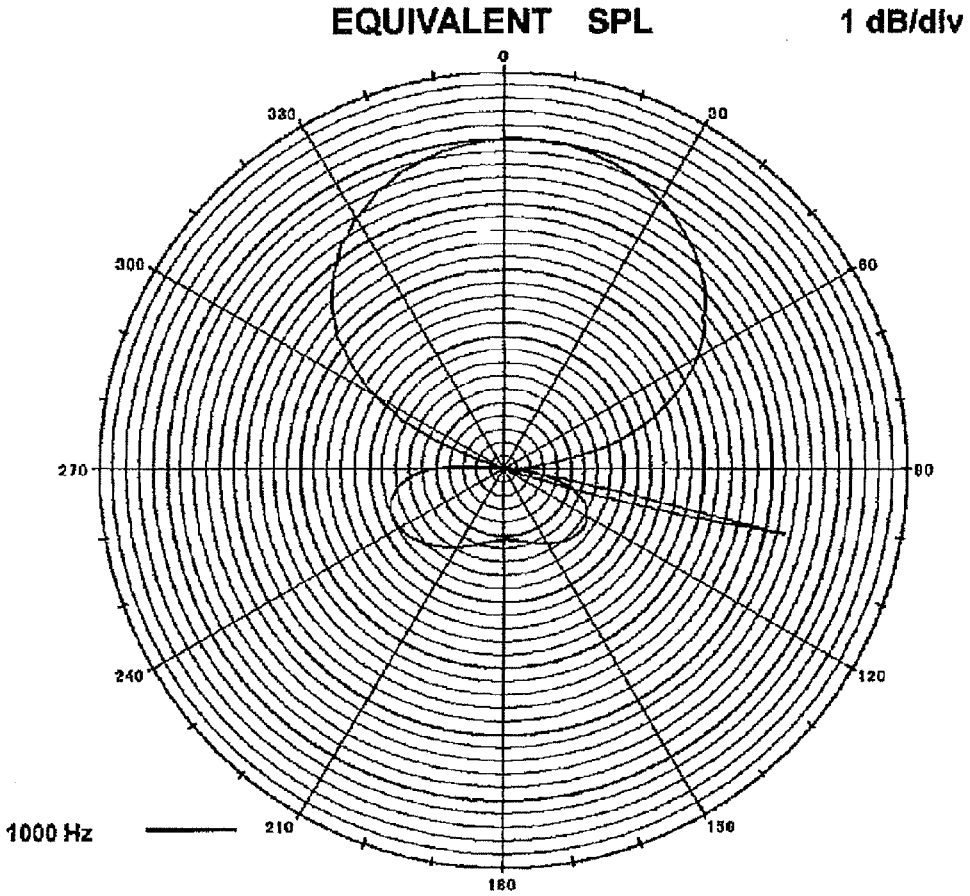
FIG. 3 is a directional characteristic diagram when the acoustic tube of the embodiment is elongated by 2.5 mm.
Figure 4:
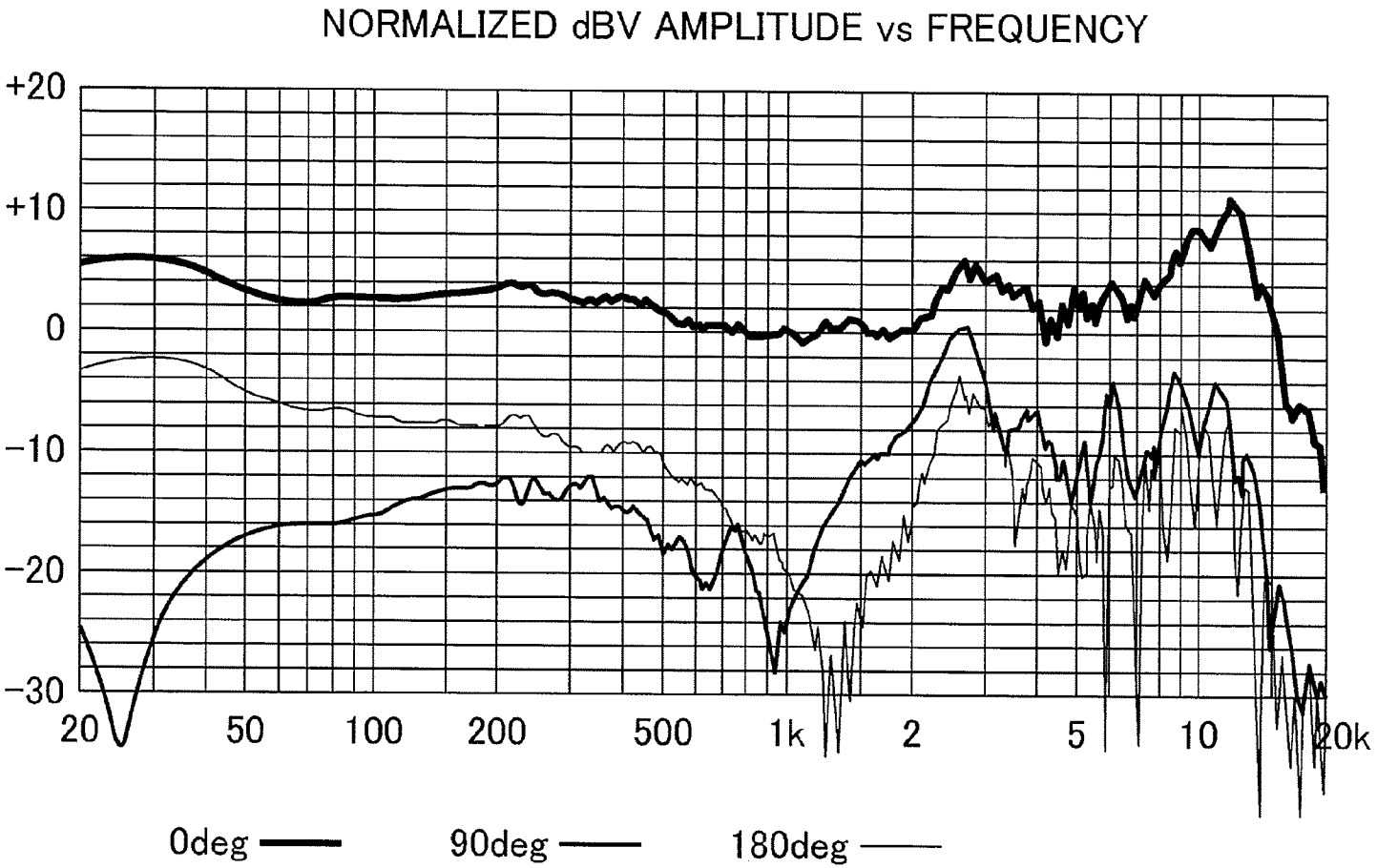
FIG. 4 is a frequency response characteristic diagram when the acoustic tube of the embodiment is elongated by 2.5 mm.
Figure 5:
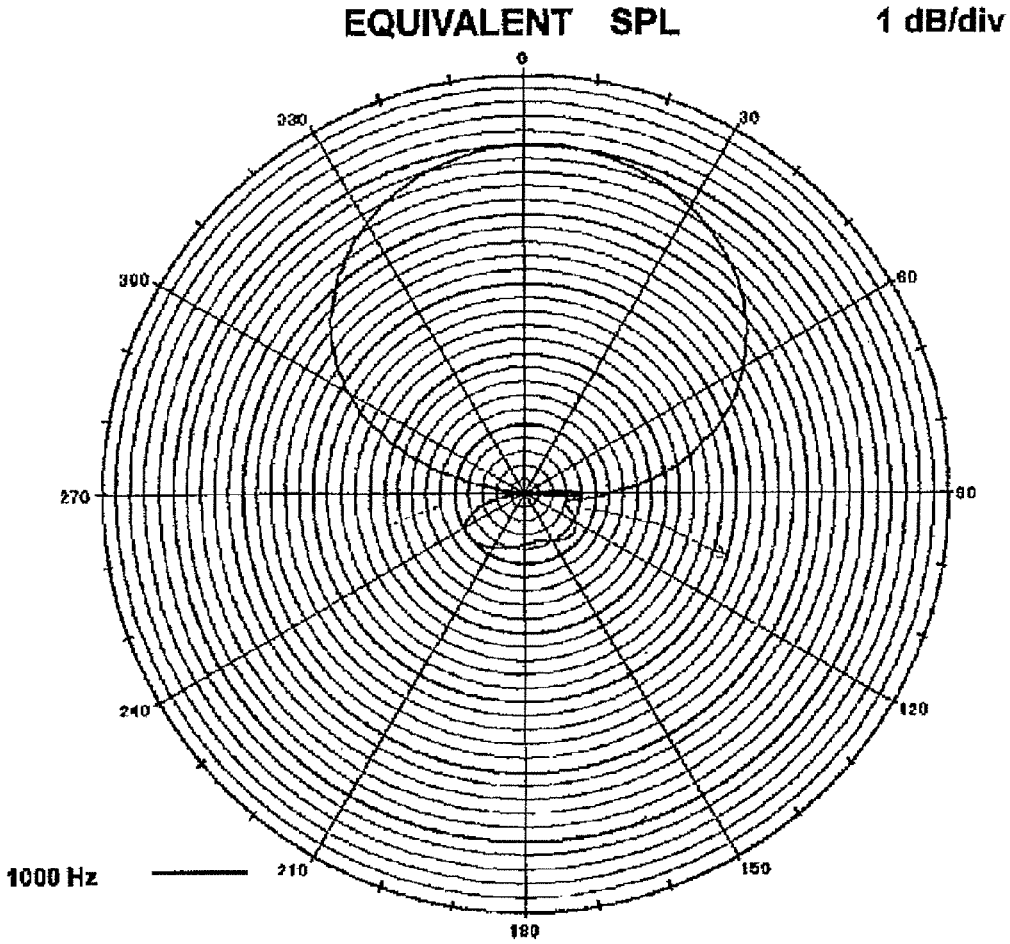
FIG. 5 is a directional characteristic diagram when the acoustic tube of the embodiment is elongated by 5.0 mm.
Figure 6:
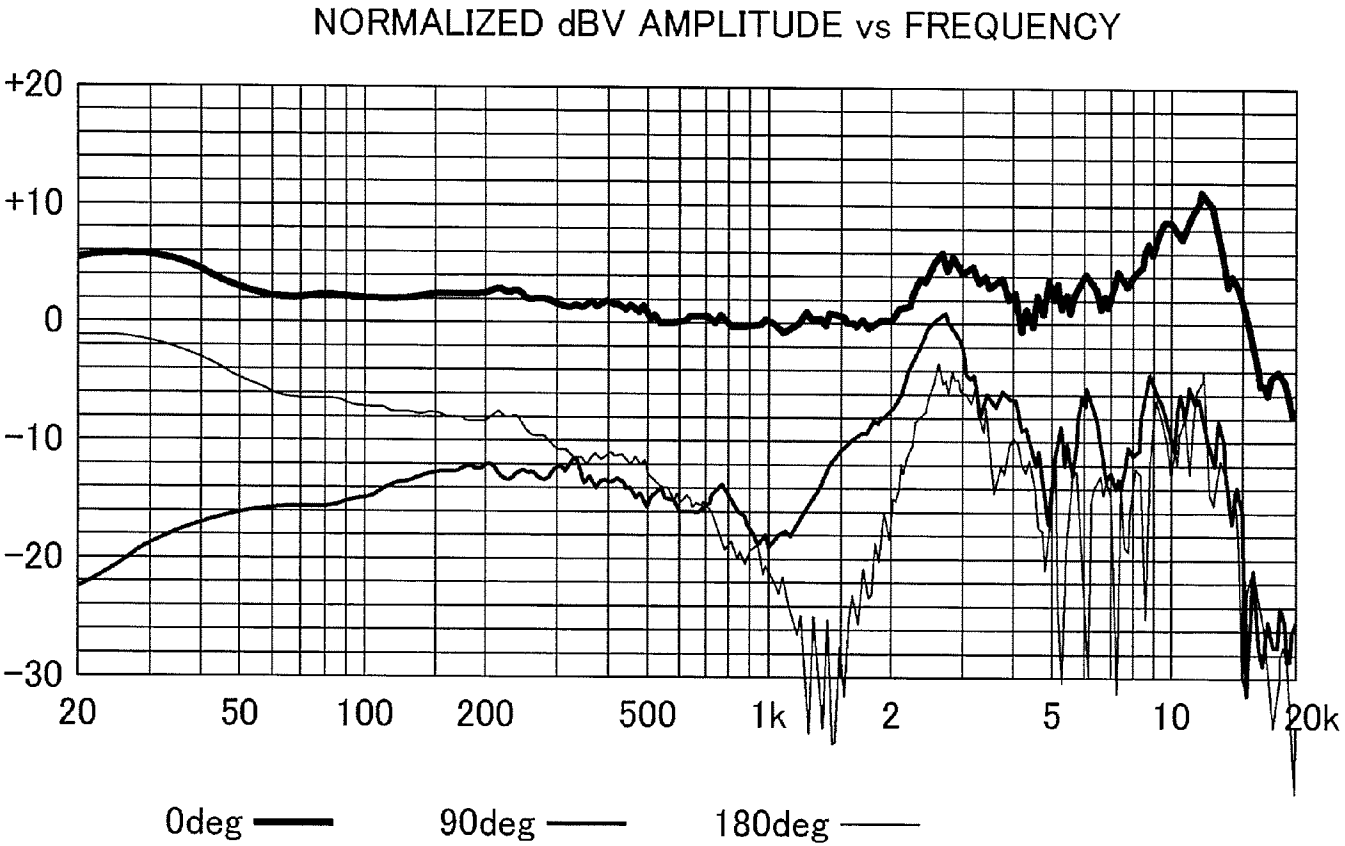
FIG. 6 is a frequency response characteristic diagram when the acoustic tube of the embodiment is elongated by 5.0 mm.
Figure 7:
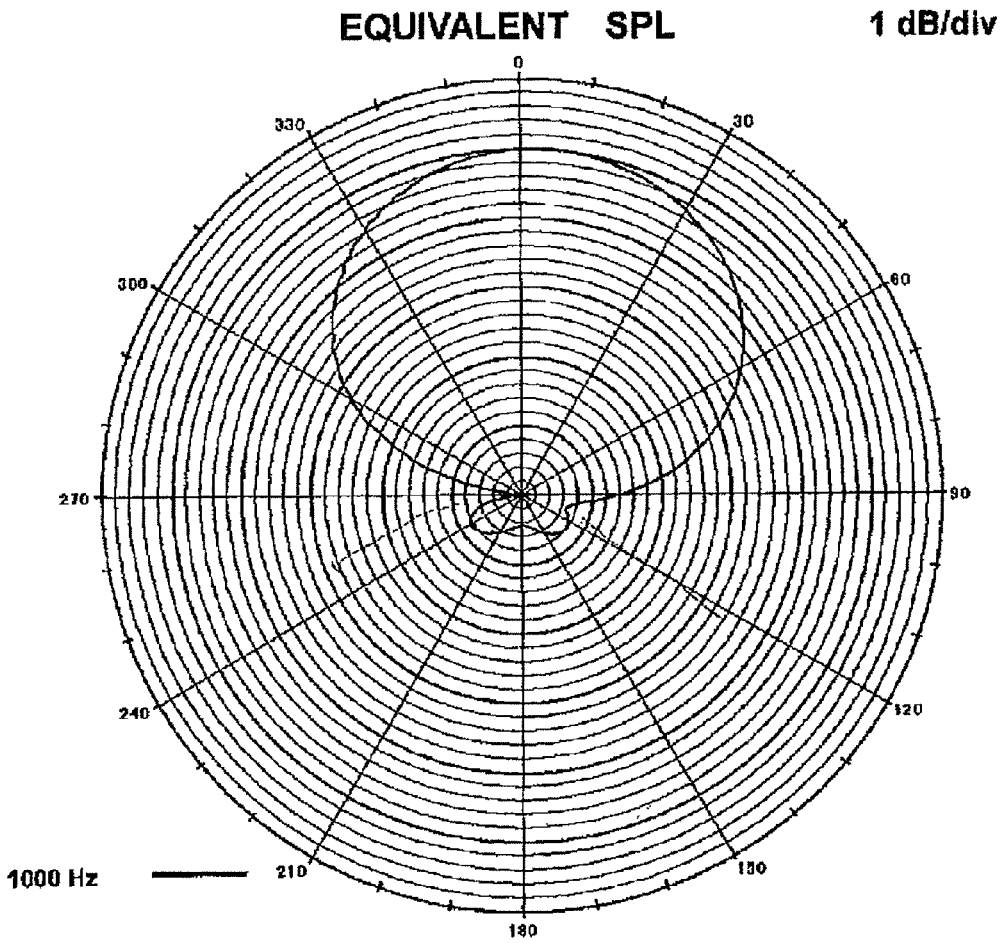
FIG. 7 is a directional characteristic diagram when the acoustic tube of the embodiment is elongated by 7.5 mm.
Figure 8:
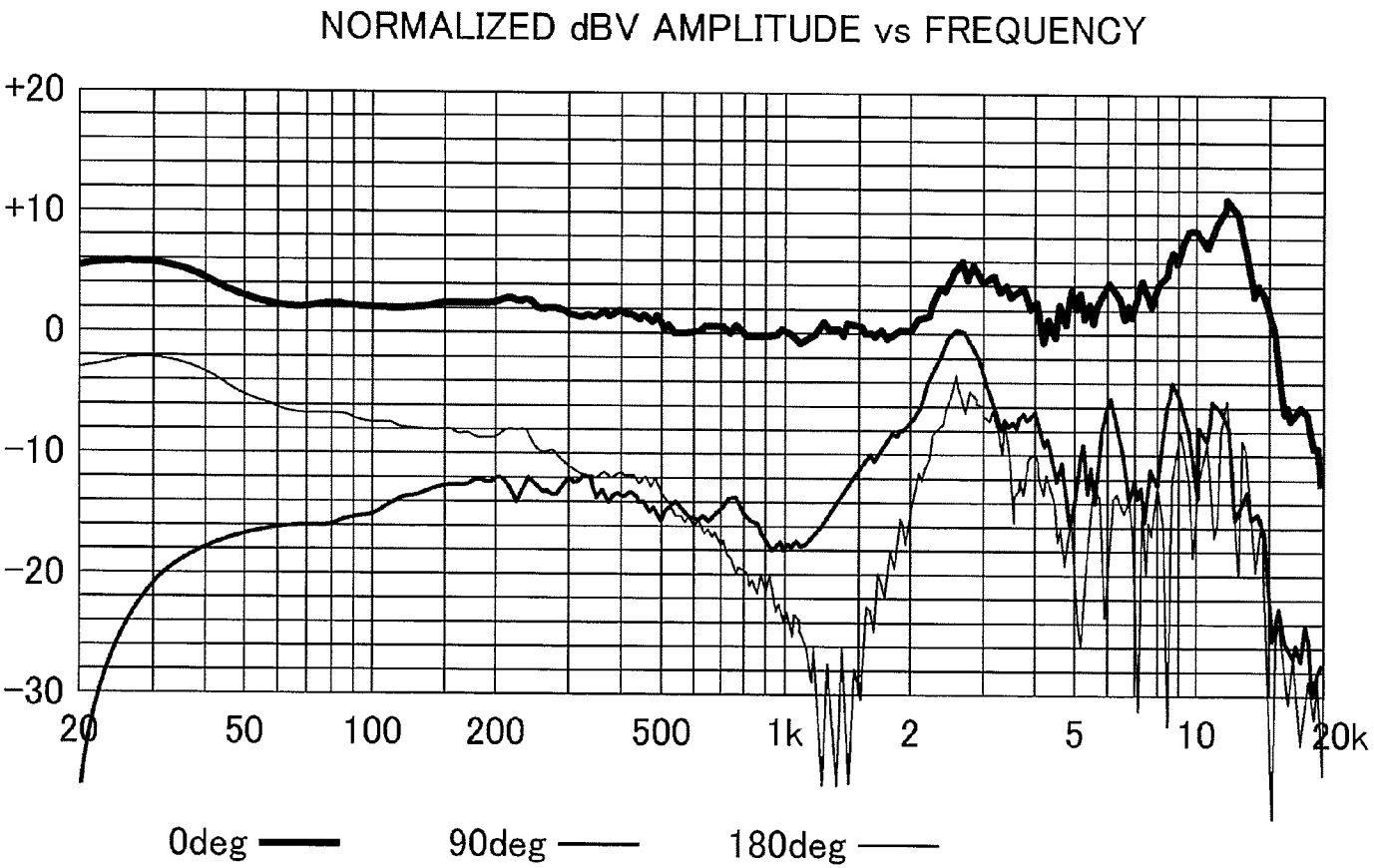
FIG. 8 is a frequency response characteristic diagram when the acoustic tube of the embodiment is elongated by 7.5 mm.
Figure 9:
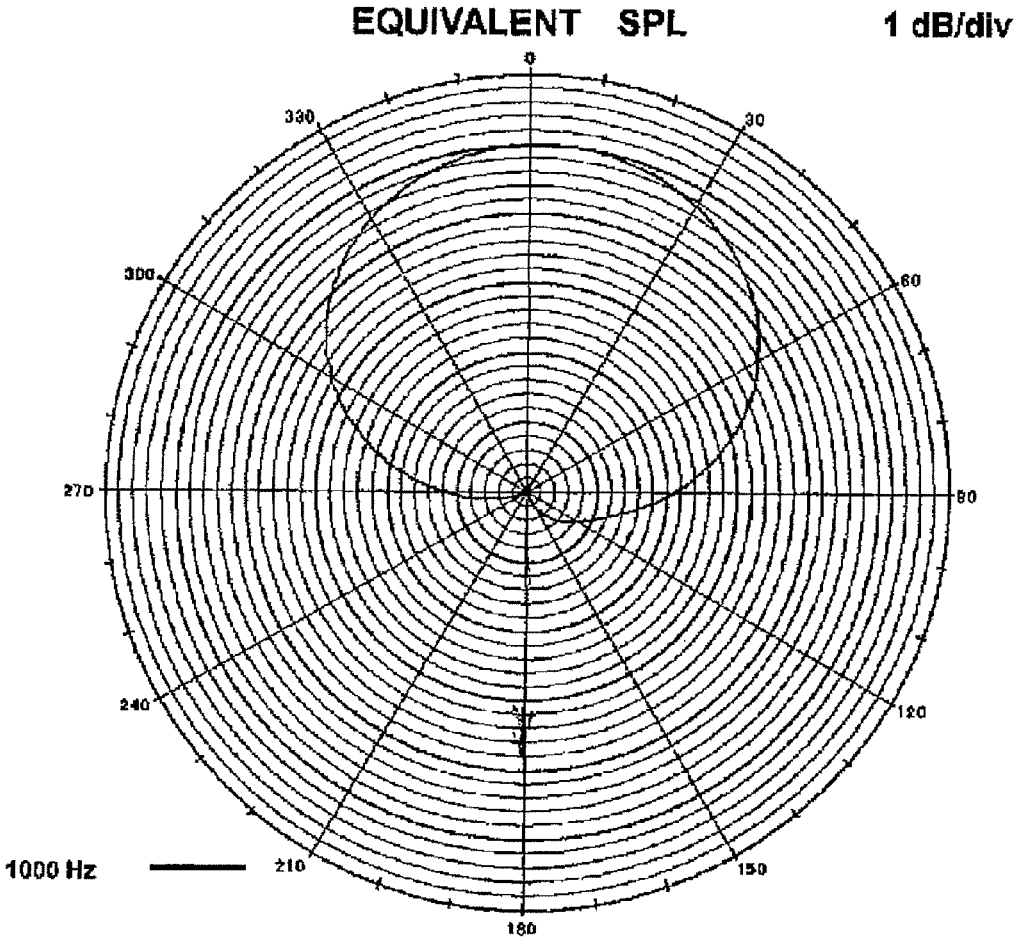
FIG. 9 is a directional characteristic diagram when the acoustic tube of the embodiment is elongated by 10.0 mm.
Figure 10:
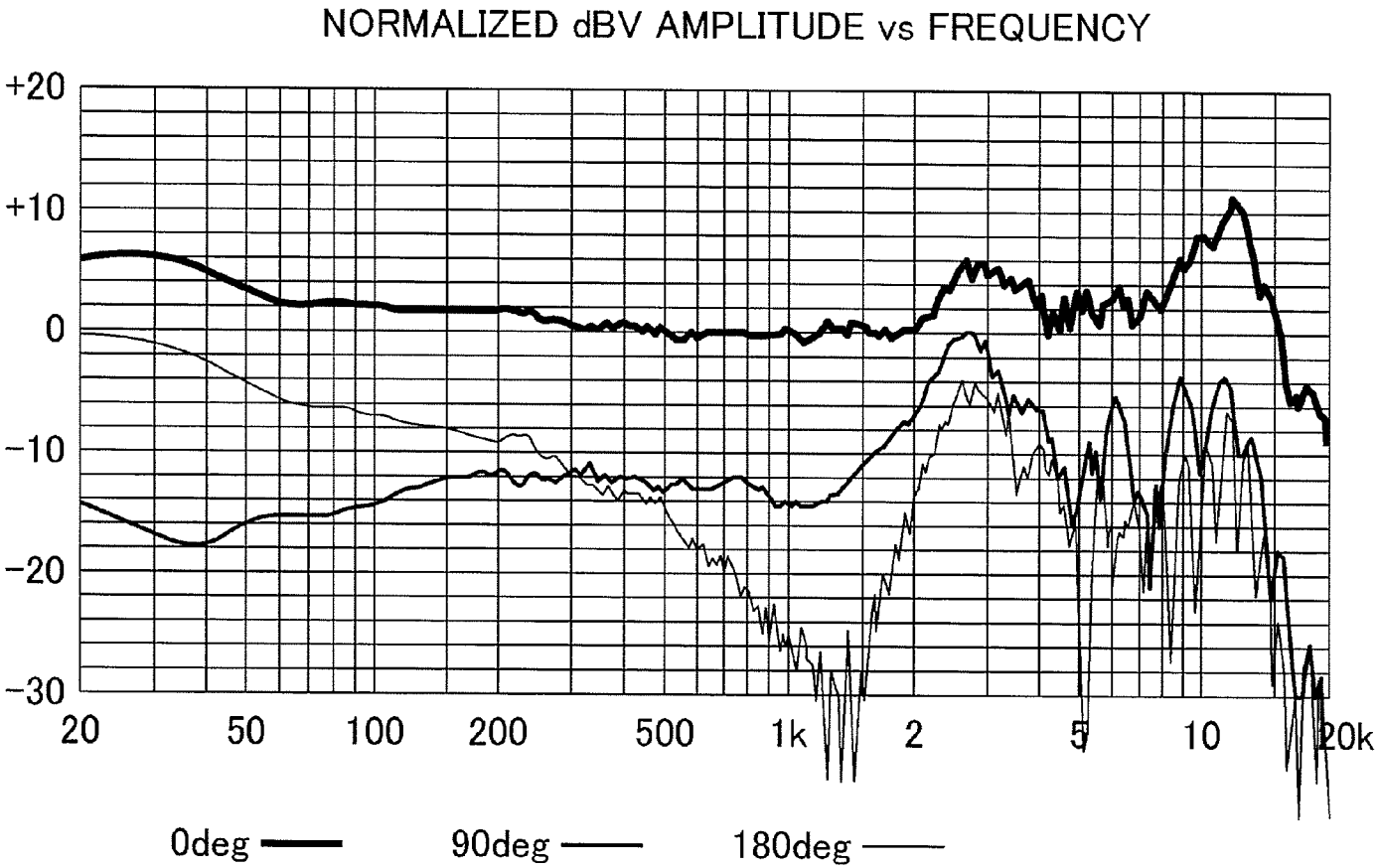
FIG. 10 is a frequency response characteristic diagram when the acoustic tube of the embodiment is elongated by 10.0 mm.
Figure 11:
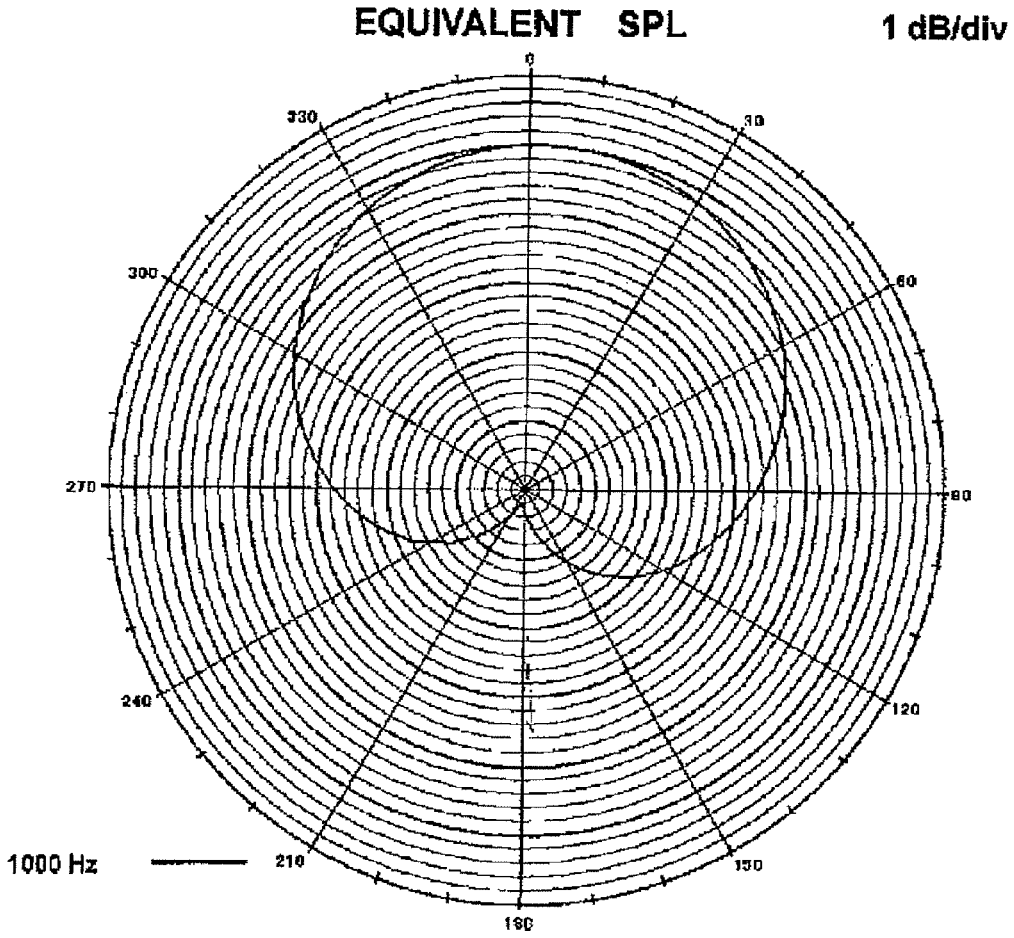
FIG. 11 is a directional characteristic diagram when the acoustic tube of the embodiment is elongated by 12.5 mm.
Figure 12:
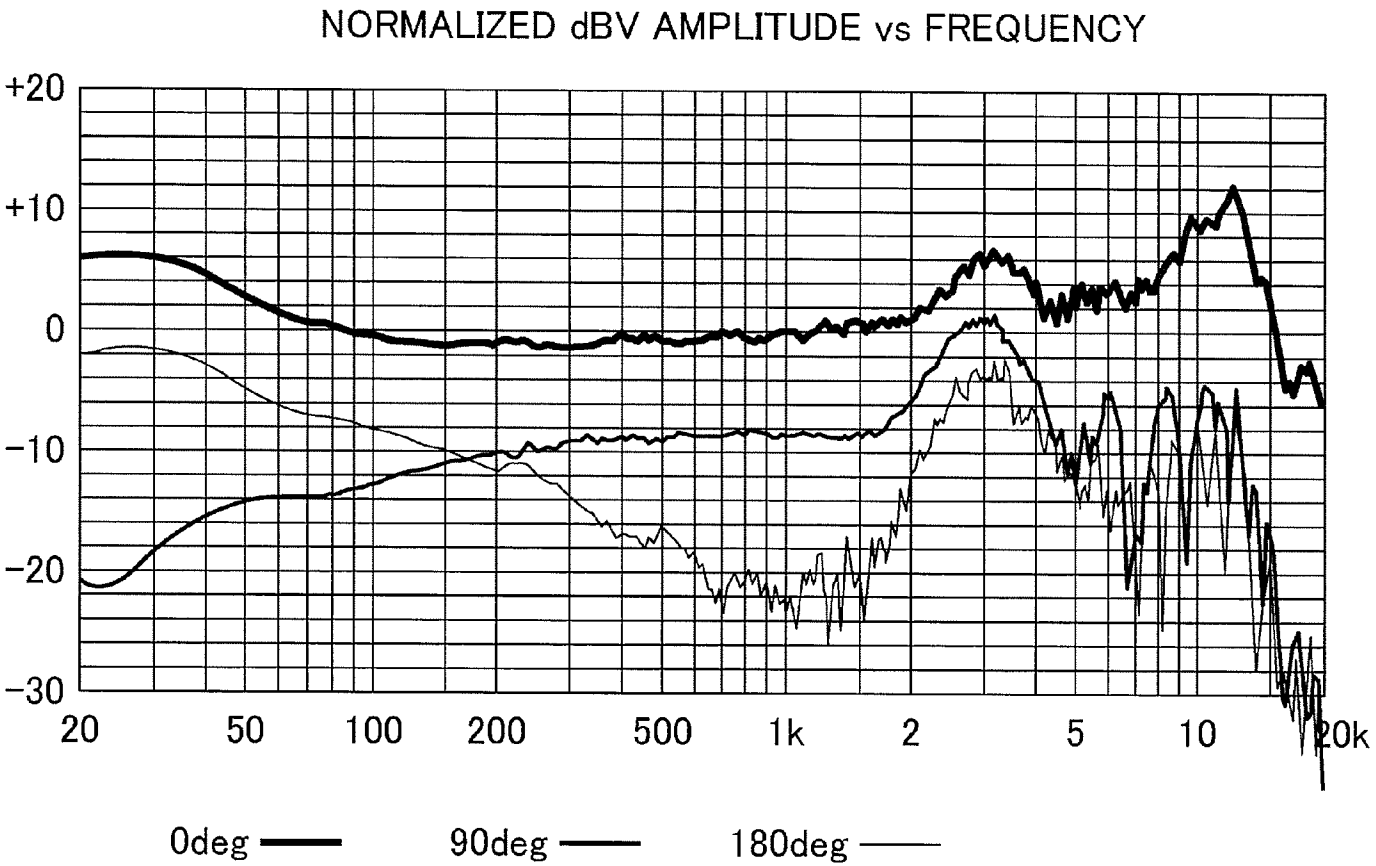
FIG. 12 is a frequency response characteristic diagram when the acoustic tube of the embodiment is elongated by 12.5 mm.
Figure 13:
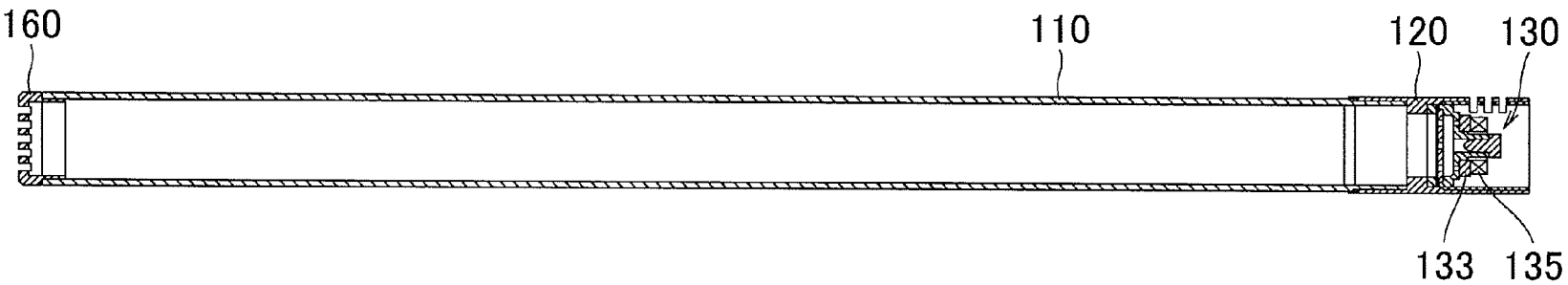
FIG. 13 is a vertical cross-sectional view of a typical conventional highly directional microphone.

FIGS. 1A, 1B, 2A and 2B illustrate a highly directional microphone according to the embodiment of the present invention. FIGS. 1A and 1B depict the overall structure, and FIGS. 2A and 2B depict only the concept or principle of the present invention which is excerpted from the above embodiment. The concept of the present invention will be described below. FIGS. 2A and 2B illustrate an acoustic tube 10 and a microphone unit 30. The microphone unit 30 is assembled to the inside of a tubular microphone holder 20 that is fitted to the base end of the acoustic tube 10. The microphone unit 30, thus, is substantially disposed inside the base end of the acoustic tube 10. The acoustic tube 10 is composed of an elastic material, such as porous rubber having numerous openings 11 through which sound waves travel. A condenser microphone unit is used as the microphone unit 30 and the microphone unit 30 itself has unidirectional directivity and hypercardioid characteristics.

FIG. 2A illustrates the original state where pull strength is not applied to the acoustic tube 10, while FIG. 2B illustrates a state where the acoustic tube 10 is elongated by the pull strength applied to the front end thereof. The numerous openings 11 are also elongated with the elongation of the acoustic tube 10. The elongation of the acoustic tube 10 reduces the interference frequency inside the acoustic tube 10 to enhance the narrow directivity at a low-frequency range. Furthermore, the elongation of the numerous openings 11 with the elongation of the acoustic tube 10 results in a reduction in acoustic resistance of the peripheral wall of the acoustic tube 10. This reduction in the acoustic resistance changes the directivity of the microphone unit 30 from hypercardioid directivity to omnidirectional directivity. The directivity, thus, can be changed. When a noise source is lateral to the acoustic tube 10 (90-degree direction), the hypercardioid directivity is applied without elongation of the acoustic tube 10, while the noise source is behind the acoustic tube 10 (180-degree direction), the cardioid directivity is applied with elongation of the acoustic tube 10, thereby preventing noise pickup.

FIGS. 1A and 1B illustrate an embodiment in which the above-explained principle of variable directivity is developed to a practical level. FIGS. 1A and 1B depict the elastic acoustic tube 10 that is fitted into the inner periphery of an acoustic-tube protector 40. For example, the acoustic-tube protector 40 is formed by partly removing the peripheral wall of a cylindrical member other than a base end 41 (adjacent to the microphone unit 30) and a front end 42 in the axis direction to make openings 43 through which the sound waves freely travel. The acoustic-tube protector 40 can keep its stiffness as a whole. A slight gap is provided between the outer periphery of the acoustic tube 10 and the inner periphery of the acoustic-tube protector 40, and the acoustic tube 10 can be elongated or contracted relative to the acoustic-tube protector 40. As explained above, the acoustic tube 10 is composed of an elastic material, such as porous rubber having numerous openings 11 through which sound waves travel. The base end of the acoustic tube 10 is integrated to the inner periphery of the base end 41 of the acoustic-tube protector 40.

A cylindrical acoustic-tube holder 22 of a tubular microphone unit holder 20 is fitted to the outer periphery at the base end 41 of the acoustic-tube protector 40 to be integrated with the acoustic-tube protector 40. A cylindrical microphone unit holder 21 is integrated to the rear end of the tubular microphone unit holder 20 and accommodates the microphone unit 30 therein. As is well known, the microphone unit 30 of this embodiment according to the present invention is a condenser microphone unit comprising a diaphragm 31 composed of a thin film; a fixed electrode 32 that faces the diaphragm 31 with a slight gap therebetween; a rear acoustic terminal that conducts external air therethrough to an air chamber formed at the back surface of the diaphragm 31; and an acoustic resistor 33 disposed so as to cover the rear acoustic terminal. The rear acoustic terminal urges the acoustic resistor 33 by an appropriate urging force with a nut 35 to generate an appropriate acoustic resistance. The microphone unit 30 is assembled such that the diaphragm 31 therein faces the front end of the acoustic tube 10.

A sliding cylinder 50 is slidably fitted inside the inner periphery at the front end 42 of the acoustic-tube protector 40 in the axis direction thereof, that is, the axis direction of the acoustic tube 10, with being guided by the inner periphery at the front end 42. An appropriate number of thread holes 51 is aligned on the sliding cylinder 50 parallel to the axis of the acoustic tube 10. As shown in the example of FIG. 1B, the two thread holes 51 are symmetrically formed on opposite sides of the central axis of the sliding cylinder 50. A front cap 60 is fitted to the front end of the acoustic-tube protector 40. Two adjustable threads 70 are inserted into the front cap 60 parallel to the axis of the acoustic-tube protector 40. The two adjustable threads 70 are respectively screwed into the thread holes 51 on the sliding cylinder 50 through the acoustic-tube protector 40. The sliding cylinder 50 moves along the acoustic-tube protector 40 by adjusting with adjustable threads 70 so as to elongate and contract the acoustic tube 10 that is connected to the acoustic-tube protector 40.

Since the expansion and contraction of the acoustic tube can be adjusted by controlling the pull strength at the front end of the acoustic tube without adjusting at the end adjacent to the microphone unit, the directivity can be adjusted without damaging the microphone unit by the user. Fine adjustment of the directivity can be achieved by elongating and contracting the acoustic tube.

A gist of the present invention is to provide a highly directional microphone including the acoustic tube 10; and the microphone unit 30 disposed inside the base end of the acoustic tube 10, in which the acoustic tube 10 is composed of an elastic material and an adjustable member (adjustable threads 70 in the embodiment in FIG. 1B) increases or decreases the distance between the microphone unit 30 and the front end of the acoustic tube 10. Practically, the acoustic tube 10 can be maintained at a predetermined elongated or contracted position by holding or protecting the acoustic tube 10 by a rigid member. In the example illustrated in FIGS. 1A and 1B, the acoustic tube 10 can be elongated or contracted by the operation from the outside of the acoustic-tube protector 40. With this configuration, the directivity of the highly directional microphone can be adjusted by the user to achieve fine adjustments to the directivity.

For example, the elastic acoustic tube 10 having numerous holes 11 may be composed of a sponge member similar to that for generating bubbles in the water in an aquarium. An exemplary process for manufacturing the member involves shaping of a rubber mixed with water-soluble particles into a tube and dissolution of the particles with water. Accordingly, holes through which sound waves travel are formed in the portions corresponding to the dissolved particles in the rubber.

While the length of the acoustic tube 10 of the highly directional microphone according to the above-explained embodiment was adjusted, the directional characteristics and the frequency response characteristics were measured at each length under a standardized condition. The length of the acoustic tube 10 in the original state where pull strength was not applied thereto was 100 mm. FIGS. 3, 5, 7, 9, and 11 depict the directional characteristics when the acoustic tube 10 is elongated by 2.5 mm, 5.0 mm, 7.5 mm, 10.0 mm, and 12.5 mm, respectively, from 100 mm in the original state. FIGS. 4, 6, 8, 10 and 12 depict the frequency response characteristics when the acoustic tube 10 is elongated by 2.5 mm, 5.0 mm, 7.5 mm, 10.0 mm, and 12.5 mm, respectively, from 100 mm in the original state. With respect to the frequency response characteristics, a heavy line, a middle-thick line, a thin line represent a sound source at the front (0-degree direction), a sound source at the side (90-degree direction), and a sound source at the rear (180-degree direction) of the acoustic tube 10.

As is obvious from FIGS. 3, 5, 7, 9, and 11, the directional characteristics vary from hypercardioid to cardioid as the length of the acoustic tube 10 increases. FIGS. 4, 6, 8, 10, and 12 show no substantial variation in the frequency response characteristics, and in particular, little variation in the sound source at the front direction.

With the highly directional microphone according to the present invention, even a general user who does not get used to handle microphones can readily adjust the directivity. Demand for the highly directional microphone, therefore, can be expected not only by professional sound technicians but also by general users.

What is claimed is:

1. A highly directional microphone comprising:
an acoustic tube; and
a microphone unit disposed inside a base end of the acoustic tube,
wherein
the acoustic tube comprises:
an elastic material,
an adjustable member elongates and contracts the acoustic tube to adjust a distance between the microphone unit and a front end of the acoustic tube, and
a plurality of openings through which sound waves travel,
wherein each of the plurality of openings is configured to elongate and to contract with elongation and contraction of the acoustic tube.

2. The highly directional microphone according to claim 1, further comprising:
an acoustic-tube protector having openings on a peripheral wall thereof, the acoustic-tube protector holding the acoustic tube, the base end of the acoustic tube being integrated to the acoustic-tube protector, the front end of the acoustic tube being connected to a sliding cylinder that is slidably fitted in an axis direction of the acoustic tube along the acoustic-tube protector.

3. The highly directional microphone according to claim 2, wherein the sliding cylinder is provided such that a position thereof is slidable in the axis direction of the acoustic tube by adjustment of the adjustable member.

4. The highly directional microphone according to claim 3, further comprising:
a front cap fitted to a front end of the acoustic-tube protector,
wherein the adjustment member comprises an adjustable thread, the adjustable thread is inserted into the front cap parallel to an axis of the acoustic-tube protector, the adjustable thread is screwed into the sliding cylinder, and the sliding cylinder is movable along the acoustic-tube protector by adjustment of the adjustable thread so as to elongate and contract the acoustic tube.

5. The highly directional microphone according to claim 1, wherein the microphone unit is a condenser microphone unit and is assembled such that a diaphragm therein faces the front end of the acoustic tube.

6. The highly directional microphone according to claim 1, further comprising:
a tubular microphone unit holder,
wherein the microphone unit is disposed inside the tubular microphone unit holder, and the tubular microphone unit holder is connected to a base end of the acoustic tube.

7. The highly directional microphone according to claim 1, wherein directivity of the microphone unit is unidirectional directivity.

8. A highly directional microphone comprising:
an acoustic tube; and
a microphone unit disposed inside a base end of the acoustic tube,
wherein the acoustic tube comprises:
an elastic material,
an adjustable member elongates and contracts the acoustic tube to adjust a distance between the microphone unit and a front end of the acoustic tube, and
a plurality of openings through which sound waves travel, wherein each of the plurality of openings is configured to elongate and to contract with elongation and contraction of the acoustic tube, and wherein the elongation and the contraction of the plurality of openings reduces the interference frequency inside the acoustic tube to enhance the narrow directivity of the highly directional microphone at a low-frequency range.

9. A highly directional microphone comprising:

an acoustic tube; and a microphone unit disposed inside a base end of the acoustic tube, wherein the acoustic tube comprises:

an elastic material, an adjustable member elongates and contracts the acoustic tube to adjust a distance between the microphone unit and a front end of the acoustic tube, and a plurality of openings through which sound waves travel, wherein each of the plurality of openings is configured to elongate and to contract with elongation and contraction of the acoustic tube, and wherein the elongation and the contraction of the plurality of openings reduces the acoustic resistance of the peripheral wall of the acoustic tube to change the directivity of the highly directional microphone.

* * * * *